United States Patent [19]

Criswell et al.

[11] 4,335,683

[45] Jun. 22, 1982

[54] FLUIDIZED BED HEAT EXCHANGER WITH CONTROL TO RESPOND TO CHANGES IN DEMAND

[75] Inventors: Robert L. Criswell, Florham Park; Michael C. Polagye, Madison, both of N.J.

[73] Assignee: Foster Wheeler Energy Corporation, Livingston, N.J.

[21] Appl. No.: 252,545

[22] Filed: Apr. 9, 1981

[51] Int. Cl.[3] ..... F22B 1/02

[52] U.S. Cl. ..... 122/4 D; 122/449; 110/245; 110/101 CF

[58] Field of Search ..... 432/58, 15; 122/4 D, 122/22, 449; 110/245, 327, 347, 101 R, 101 C, 101 CF, 101 CA, 101 CB, 101 CD, 185–190; 431/7, 170

[56] References Cited

U.S. PATENT DOCUMENTS

| | | | |
|---|---|---|---|
| 2,344,328 | 3/1944 | Schrage | 110/101 CF |
| 3,605,655 | 9/1971 | Warshawsky et al. | 110/245 |
| 3,687,115 | 8/1972 | Bell | 122/7 R |
| 3,888,194 | 6/1975 | Kishigami et al. | 110/245 |
| 3,924,402 | 12/1975 | Hanboe | 122/4 D |
| 4,072,130 | 2/1978 | Zenz | 122/4 D |
| 4,267,801 | 5/1981 | Robinson | 122/4 D |
| 4,278,052 | 7/1981 | Sharp | 122/449 |

*Primary Examiner*—Henry C. Yuen

*Attorney, Agent, or Firm*—Marvin A. Naigur; John E. Wilson; Richard L. Aitken

[57] ABSTRACT

In a fluidized boiler system, the rate of fuel flow and bed depth are simultaneously controlled in response to variations in a load demand signal representing the need for steam output from the system. When the load demand changes, the rate of fuel flow is varied accordingly to provide a change in the bed temperature to thus provide a rapid response to the change in the demand signal. At the same time, the system changes the rate of flow of limestone to the bed and the rate of removal of spent particulate material of the bed to change the bed depth to respond more slowly to the change in the demand signal. As the depth of the fluidized bed approaches a value corresponding to the demand signal, the temperature of the bed will change back toward a median value.

6 Claims, 3 Drawing Figures

FLUIDIZED BED HEAT EXCHANGER WITH CONTROL TO RESPOND TO CHANGES IN DEMAND

BACKGROUND OF THE INVENTION

This invention relates to a fluidized bed heat exchanger system and, more particularly, to an improved system for controlling the fluidized bed to rapidly respond to changes in demand in heat output from the fluidized bed.

The use of fluidized beds has long been recognized as an attractive means for generating heat. In the fluidized bed, air is passed through a bed of particulate material which includes a mixture of fuel material, such as high sulfer bituminous coal and an absorbent material, such as limestone, for the sulfur released as a result of the combustion of the coal. As a result of the air passing through the bed of particulate material, the bed is fluidized, which promotes combustion of the fuel. The basic advantages of the fluidized bed include a relatively high heat transfer rate, combustion at low temperatures, ease of handling of fuel waste materials, a reduction of corrosion and boiler fouling, and a reduction in boiler size.

SUMMARY OF THE PRESENT INVENTION

In accordance with the present invention, a control system is provided to make the fluidized bed heat exchanger system respond rapidly to changes in demand for the heat output from the fluidized bed. The heat output from the fluidized bed varies with the depth of the fluidized bed and with the temperature of the fluidized bed and to change the heat output from a fluidized bed, the bed depth may be changed or the bed temperature may be changed. However, the bed depth can be changed only at a relatively low rate and this method of varying the heat output of the fluidized bed is not effective in satisfying rapid changes in demand. On the other hand, the bed temperature must be kept within relatively narrow limits, above a lower limit to maintain combustion in the fluidized bed, and below an upper limit to prevent damage to the boiler tubes and maintain the sulfur capture by the limestone effective.

The control system of the present invention provides rapid response to changes in demand while maintaining the temperature of the bed within temperature limits. In accordance with the present invention, in response to changes in demand, the fuel flow rate is increased or decreased to change the bed temperature allowing the temperature to rise or fall to the temperature limit if necessary. At the same time, the depth of the bed is adjusted at a lower rate in response to the change in demand. As the bed depth approaches a level to satisfy the demand, the bed temperature is brought back to a value between the temperature limits. In this manner, a fluidized bed heat exchanger system is provided which is quickly responsive to changes in the output demand from the system. Further advantages and objects of the invention will become readily apparent from the following detailed description of the invention when considered in conjunction with the accompanying drawings.

DESCRIPTION OF THE PREFERRED EMBODIMENT

Figure 1:
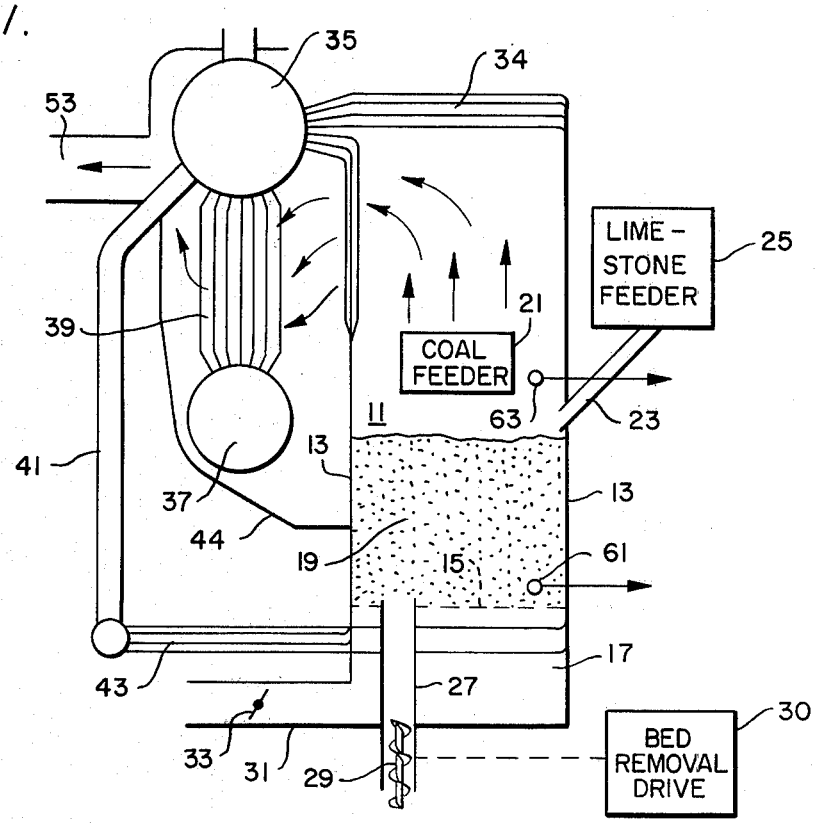
FIG. 1 schematically illustrates a fluidized bed heat exchanger system in the form of a steam boiler in which the control system of the present invention is incorporated.

The firebox and boiler structure of the fluidized bed heat exchanger system of the present invention is similar to that disclosed in U.S. Pat. No. 4,184,455, which is hereby incorporated by reference. As schematically illustrated in FIG. 1, the fluidized bed heat exchanger system comprises a combustion chamber 11 which is defined by sidewalls 13 and an air distribution plate 15 at the bottom of the combustion chamber. Beneath the air distribution plate 15 is an air distribution chamber 17 within the sidewalls 13. A bed of particulate material 19 is disposed within the combustion chamber 11 and is supported by the air distribution plate 15. The bed of particulate material includes a mixture of crushed coal and limestone, which operates as an absorbent for sulfur released during the combustion of the coal. A spreader feeder 21 introduces the coal into the chamber 11 and adds it to the bed of particulate material. A limestone feed pipe 23 feeds limestone into the bed of particulate material from the limestone feeder 25. A drain 27 is provided extending through the plate 15 and a screw 29 located in the drain operates to remove spent particulate material from the bed 19 through the drain. The screw 29 is driven by the bed removal drive 30 and the rate that the particulate material is removed through the drain 27 is determined by the speed that the screw is driven.

The sidewalls 13 of the combustion chamber 11 are formed by a plurality of tubes having two longitudinally extending fins connected to diametrically opposite portions thereof with the fins of adjacent tubes being welded together to form a gas-tight structure. An air distribution duct 31 is connected to the air distribution chamber 17 for introducing air into the chamber 17 and from there through the plate 15 into the bed 19 of particulate material. The rate of air flow through the duct 31 is controlled in a conventional manner by a damper 33 located in the duct to maintain 5 percent oxygen in the chamber 11 above the fluidized bed. The air introduced in this manner into the bed 19 is introduced at a rate to fluidized the bed and promote the combustion of the particulate fuel material.

The tubes which form the sidewalls 13 connect through a header and riser system 34 to steam drum 35. Downcomer 41 extends downwardly from the steam drum and connects to a feedpipe and header system 43, which lead to the lower ends of the tubes forming the sidewalls 13. The steam drum 35, a mud drum 37, and boiler bank 39 are enclosed within an outer vessel wall 44 which communicates with the combustion chamber 11 at the top thereof and a gas outlet 53 is provided in this vessel wall. The products of combustion produced in the chamber 11 by the combustion of the fuel in the bed 19 pass over the boiler bank 39 and then out through the gas outlet 53.

In operation, air is passed through the air duct 31 under the control of the damper 33 into the air distribution chamber 17 for passage upwardly through the plate 15 into the bed of particulate material 19. The passage of air through the bed 19 fluidizes the material of the bed and promotes combustion of the fuel material. The excess air mixes with the gaseous products of combustion of the fuel material and flows upwardly into the upper portion of the chamber 11 before exiting from the chamber into the vessel within the wall 44, where the excess air and combustion products pass over the boiler bank 39 and then discharge from the outlet 53.

Water is circulated between the steam drum 35 and the mud drum through the boiler bank 39 and from the downcomer 41 through the feedpipe and header system 43 into the tubes forming the sidewall 13 of the combustion chamber 11. The hot air and gases passing over the boiler bank 39 adds heat to the water passing through the tubes of the boiler bank to convert a portion of it to steam with the water steam mixture rising in the tubes by natural convection and passing into the steam drum 35. The heat generated by the fluidized bed 19 also adds heat to the water flowing through the tubes forming the sidewall 13 thereof, particularly the portions of the sidewall tubes in contact with the fluidized bed. The water that is not converted to steam recirculates and additional feedwater is supplied to the drum 35 through an inlet not shown to replenish the water that is converted to steam.

For purposes of providing an indication of the depth of the bed 19, an air pressure sensing transducer 61 is provided just above the air distribution plate 15 and a second pressure transducer 63 in the freeboard portion of the chamber 11, which is that portion of the chamber 11 above the fluidized bed. The transducer 63 is located to be above the maximum level of the upper surface of the bed 19.

Figure 3:
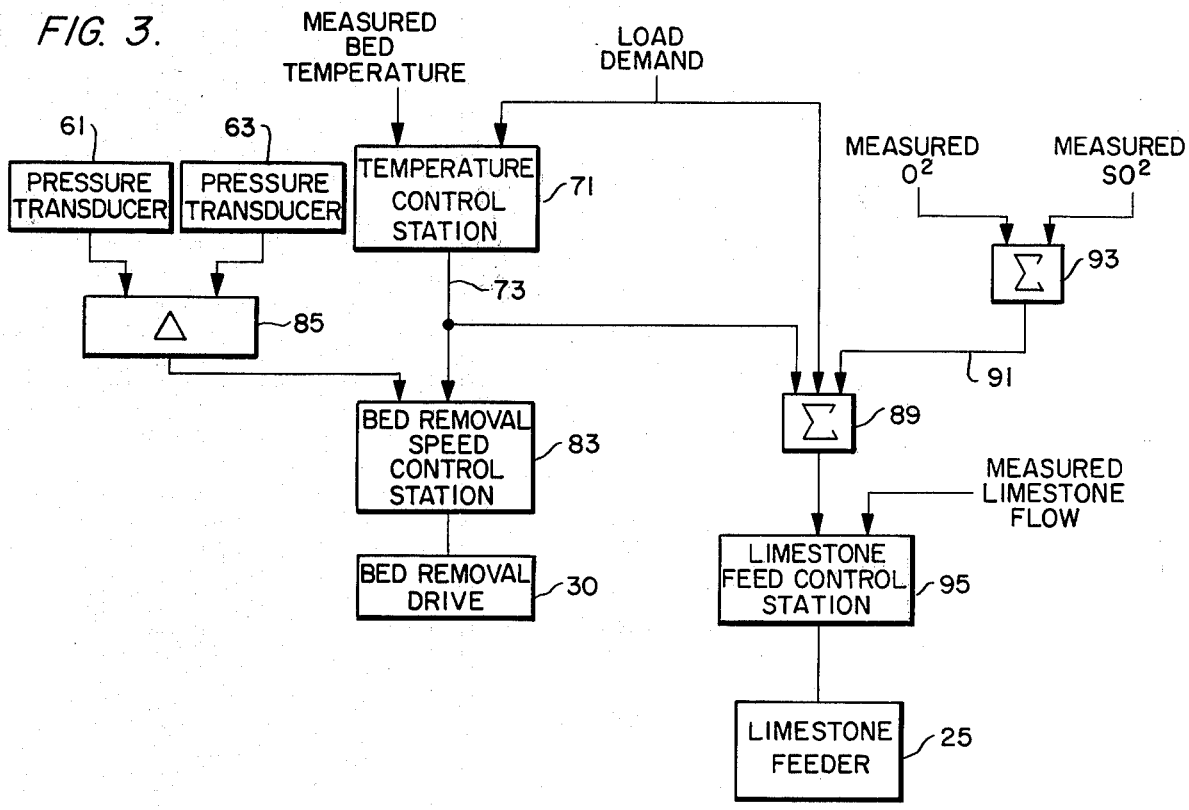
FIG. 3 is a block diagram illustrating the portion of the control system controlling the depth of the fluidized bed.
Figure 2:
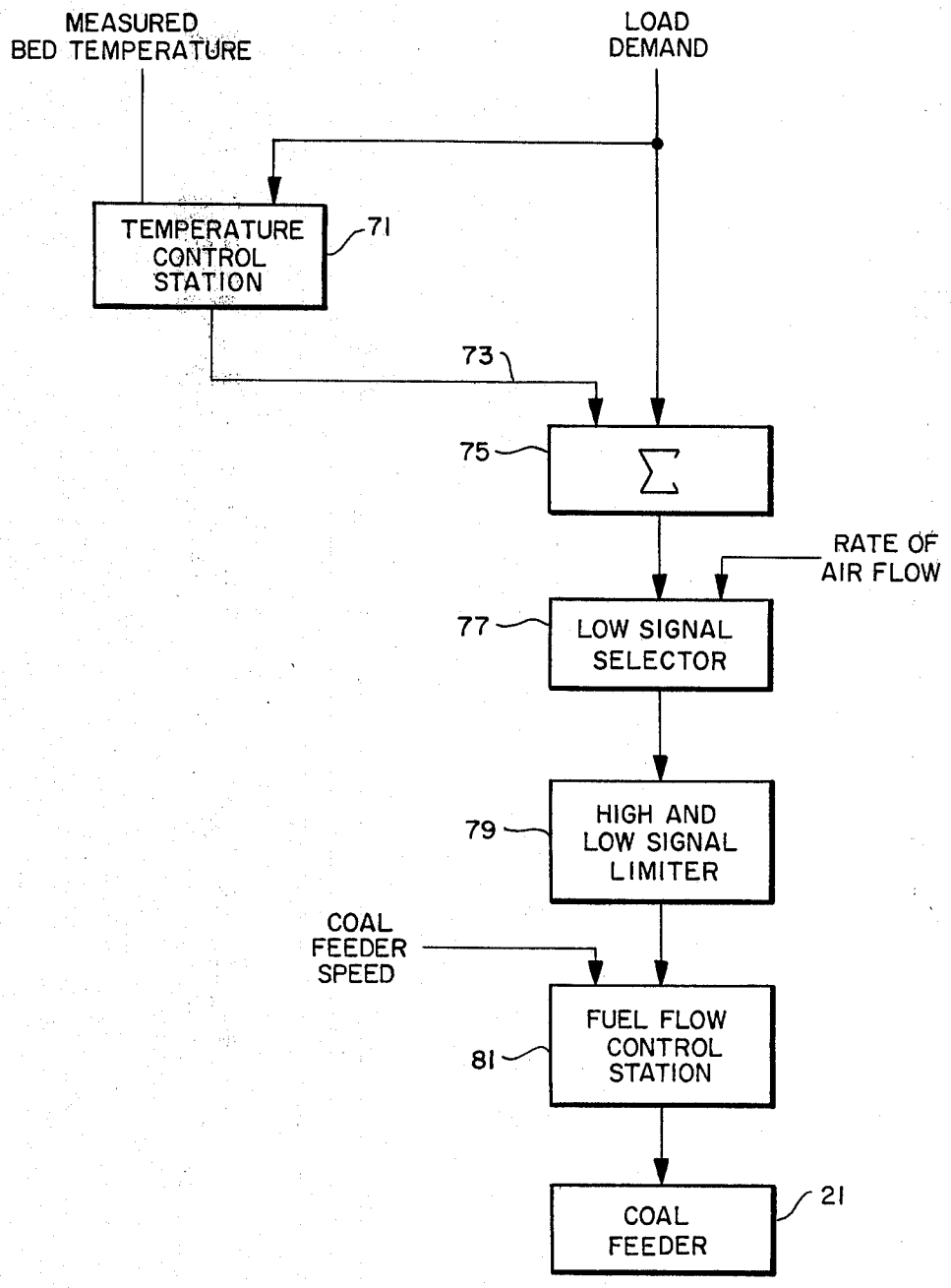
FIG. 2 is a block diagram illustrating the portion of the control system controlling the rate of fuel feed to the fluidized bed.

The control system for controlling the operation of the fluidized bed steam generator of FIG. 1 to provide steam output in accordance with the need therefor is shown in FIGS. 2 and 3. As shown in FIG. 2, which illustrates the portion of the system controlling the rate of fuel flow to the boiler, a load demand signal representing the pounds of steam per hour needed from the boiler and drum pressure is applied to a bed temperature control station 71 which also receives a signal from a temperature transducer located in the particulate bed 19 representing the bed temperature. The bed temperature control station 71 calibrates the applied load demand signal into a corresponding bed temperature and then substracts the measured bed temperature signal from the bed temperature corresponding to load demand to produce a difference signal on channel 73. The resulting difference signal is added to the load demand signal in the summing circuit 75 and the resulting composite signal is applied to a low signal selector 77. The output signal of the summing circuit 75 represents a fuel flow rate demand signal. The purpose of adding the temperature difference signal on channel 73 to the load demand signal is to provide a more rapid response when there is a large difference between the temperature corresponding to the load demand signal and the measured bed temperature. Thus, when the temperature corresponding to the load demand signal is greater than the measured bed temperature, the value of the composite signal at the output of the summing circuit 75 is increased by an amount proportional to the temperature difference. Similarly, when the measured bed temperature is greater than the temperature corresponding to the demand signal, the signal on channel 23 is negative, and the composite signal at the output of the summing signal 75 is decreased by an amount proportional to the temperature difference.

The low signal selector 77 receives a signal proportional to the rate of air flow into the bed 19 through the distributing plate 15, the distribution chamber 17 and the duct 31 as controlled by the setting of the damper 33. The air flow signal is calibrated to represent the maximum rate of fuel flow that can be provided for that rate of air flow and still maintain the bed 19 fluidized. The low signal selector 77 selects the lower of the two applied signals and applies it to the signal limiter 79. The signal limiter 79 sets a maximum upper limit for the applied signal and a minimum lower limit for the applied signal and should the applied signal 77 exceed the maximum upper limit, the output of the signal limiter 79 will be at this maximum upper limit. Similarly, should the output of the low signal selector 77 be below the minimum limit of the signal limiter 79, then the output signal of the signal limiter 79 will be at this lower limit. The upper signal limit of the signal limiter 79 corresponds to a fuel feed rate that will produce the maximum temperature permitted in the combustion chamber 11. This maximum temperature is selected to prevent overheating of the boiler tubes and also provide satisfactory sulfur capture by the limestone in the fluidized bed. The lower signal limit corresponds to a fuel feed rate which will produce a minimum permissible temperature in the fluidized bed, and also provide satisfactory sulfur capture by the limestone in the fluidized bed e.g., 1450° F. selected to make sure that the combustion process is maintained in the fluidized bed. The output signal of the signal limiter 79 represents a fuel demand signal representing a particular rate of fuel flow into the fluidized bed by the coal feeder 21 and this signal is compared with the actual rate of fuel flow as represented by the coal feeder speed in fuel flow control station 81. The difference between these signals, as determined by the fuel flow control station 81, is then used to increase or decrease the speed of the coal feeder 21 to correspond to the output signal of the signal limiter 79.

As shown in FIG. 3, which illustrates the system for controlling the depth of the fluidized bed, the output signal of the bed temperature control station 71 is also applied to bed removal speed control 83. The depth of the fluidized bed 19 is sensed by the difference in the pressure sensed by the transducer 61 positioned in the bed 19 just above the air distributing plate 15 and the transducer 63 positioned in the freeboard portion of the combustion chamber 11. The signals produced by the transducers 61 and 63 are applied to the difference circuit 85 which produces a signal representing the difference in the two measured pressures. The difference in the two measured pressures correlates with the depth of the fluidized bed and, accordingly, the output signal of the difference circuit 85 represents the depth of the fluidized bed 19. The output signal from the temperature control station 71 is compared to the output signal of the difference circuit 85 in the bed removal speed control station 83 and the resulting difference signal is used to control the speed of the bed removal drive 30 to thus control the speed of bed removal through the drain 27. In this manner, the rate that the bed material is removed from the fluidized bed through the drain 27 with decreases when the signal on channel 73 is a positive value indicating that the temperature corresponding to the load demand signal is greater than the measured bed temperature and increasing the rate of removal when the output signal on channel 73 is negative indicating that the temperature corresponding to the load demand signal is less than the measured bed temperature. Thus, with this control, the bed depth tends to increase with increases in load demand and tends to decrease with decreases in load demand.

The output signal of the temperature control station 71 is also applied to a summing circuit 89 where it is added to the load demand signal as well as another signal applied thereto on channel 91 produced by a summing circuit 93. The summing circuit 93 receives a signal representing the percentage of oxygen above the fluidized bed and a signal representing the percentage of sulfer dioxide above the fluidized bed and the sum of these two signals is applied to the summing circuit 89. The reason that the signal representing the percentage of sulfur dioxide is added to a signal representing the percentage of oxygen is that the significant measurement of sulfur dioxide which must be kept to a minimum is the pounds of sulfur dioxide produced per million BTU of fuel. By adding a signal proportional to the percentage of oxygen to a signal proportional to the percentage of sulfur dioxide, a signal is produced which is approximately proportional to this measurement.

The output signal of the summing circuit is applied to the limestone feed control station 95 where it is calibrated to represent the demanded rate of limestone flow. The limestone feed control station also receives a signal representing the measured limestone flow. The control station 95 compares the two applied signals and controls the limestone feeder in accordance with this comparison to bring the rate of limestone flow to be equal to the demanded rate represented by the output signal of the summing circuit 89.

In operation, when the demand for steam output from the boiler system increases, as represented by an increase in the load demand signal, the increased load demand signal augmented by the temperature difference signal on channel 73, will translate itself into a higher rate of fuel flow into the fluidized bed by operation of the system shown in FIG. 2. The increased fuel flow will cause a rapid increase in temperature in the fluidized bed to meet the demand. At the same time, the increase in the load demand signal, augmented by the temperature difference signal on channel 73, will increase the rate of limestone flow by the system illustrated in FIG. 3, to start to increase the bed depth. In addition, the rate of removal of bed material controlled by the bed removal drive 30 will be decreased to further increase the rate that the depth of the bed is being increased. As a result, the depth of the bed will increase until the bed depth corresponds to the load demand signal. As the bed depth increases, the temperature of the bed will tend to decrease because, for a given fuel flow rate, the temperature of the bed decreases with increases in bed depth. Thus, when the bed depth approaches the depth corresponding to the load demand signal, the temperature will drop back to a level between its upper and lower limits. Conversely, when the load demand signal decreases, the bed temperature is initially decreased rapidly by decreasing the rate of fuel flow under control of the system of FIG. 2 and, at the same time, the bed depth is reduced at a slower rate to correspond to the reduced demand under control of the system illustrated in FIG. 3. In this manner, the system of the present invention controls the fluidized bed heat exchanger system to respond rapidly to satisfy rapid changes in the demand for the output from the system while maintaining the bed temperature within the prescribed upper and lower limits.

While the present invention has been described as embodied in a steam generator, it will be appreciated that the invention can be used in other applications of fluidized beds. The above description is of a preferred embodiment, which may be extensively modified without departing from the spirit and scope of the invention as set forth in the appended claims.

What is claimed is:

1. In a combustion system having means defining a fluidized bed for combusting fuel in said fluidized bed, fuel feeding means to feed fuel into said fluidized bed under the control of a load demand signal representing the heat output required from the system, and second feeding means to feed noncombustible particulate material into said fluidized bed, the improvement comprising means to generate a temperature difference signal corresponding to the difference between a temperature corresponding to said load demand signal and the measured temperature of said fluidized bed, and means to add said temperature difference signal to said load demand signal to provide a composite signal, said fuel feeding means comprising fuel control means to vary the rate of fuel flow into said fluidized bed in accordance with said composite signal, said second feeding means comprising second control means to vary the rate of noncombustible paticulate flow into said fluidized bed in accordance with variations in said load demand signal.

2. A fluidized bed combustion system as recited in claim 1, further comprising a low signal selector connected to receive said composite signal and a signal varying in accordance with the rate of air flow through said fluidized bed calibrated to represent the maximum fuel flow into said fluidized bed while maintaining said bed in a fluidized condition, said low signal selector producing an output signal which is the lower of said composite signal and said calibrated air flow signal, said fuel control means varying the rate of said fuel flow in accordance with the output signal of said low signal selector.

3. A fluidized bed system as recited in claim 1, wherein said composite signal is applied to a high and low signal limiter, said high and low signal limiter producing an output signal varying with said composite signal between upper and lower limits and producing a signal at said upper limit when said composite signal is above said upper limit and producing an output signal at said lower limit when said composite signal is below said lower level, said fuel control means varying the rate of fuel flow to said fluidized bed in accordance with the output signal of said high and low signal limiter.

4. In a combustion system having means defining a fluidized bed for combusting fuel in said fluidized bed, fuel feeding means to feed fuel into said fluidized bed under the control of a load demand signal representing the heat output required from the system and second feeding means to feed noncombustible particulate material into said fluidized bed, the improvement comprising: means to generate a temperature difference signal corresponding to the difference between a temperature corresponding to said load demand signal and the measured temperature of said fluidized bed, means to generate a signal representing the depth of said fluidized bed, and bed removal means responsive to the difference between said signal representing the depth of said fluidized bed and said temperature difference signal to remove spent particulate material from said fluidized bed at a rate corresponding to the difference between said signal representing the depth of said fluidized bed and said temperature difference signal, said fuel feeding means comprising fuel control means to vary the rate of fuel flow into said fluidized bed in accordance with a load demand signal for heat output from said fluidized bed, said second feeding means comprising second control means to vary the rate of noncombustible particulate material flow into said fluidized bed in accordance with variations in said load demand signal.

5. In a combustion system having means defining a fluidized bed for combusting fuel in said fluidized bed, fuel feeding means to feed fuel into said fluidized bed under the control of a load demand signal representing the heat output required from the system and second feeding means to feed noncombustible particulate material into said fluidized bed, the improvement comprising means to generate a temperature difference signal corresponding to the difference between a temperature corresponding to said load demand signal and the measured temperature of said fluidized bed, summing means to add said temperature difference signal to said load demand signal to provide a composite signal, and wherein said fuel feeding means comprises fuel control means to vary the rate of fuel flow into said fluidized bed in accordance with said load demand signal, and wherein said second feeding means comprises second control means to vary the rate of noncombustible particulate material flow into said fluidized bed in accordance with said composite signal.

6. A fluidized bed system as recited in claim 5, wherein said noncombustible particulate material comprises limestone and wherein said summing means adds a component to said composite signal varying in accordance with the amount of sulfur dioxide detected above said fluidized bed.

* * * * *